US006534708B2

(12) United States Patent
Ono et al.

(10) Patent No.: US 6,534,708 B2
(45) Date of Patent: Mar. 18, 2003

(54) SIGNAL TRANSMISSION CABLE WITH A NOISE ABSORBING HIGH LOSS MAGNETIC FILM FORMED ON A SHEATH OF THE CABLE

(75) Inventors: Hiroshi Ono, Yokohama (JP); Yoshio Awakura, Yokohama (JP)

(73) Assignee: NEC TOKIN Corporation, Miyagi (JP)

( * ) Notice: Subject to any disclaimer, the term of this patent is extended or adjusted under 35 U.S.C. 154(b) by 0 days.

(21) Appl. No.: 09/825,474

(22) Filed: Apr. 3, 2001

(65) Prior Publication Data

US 2001/0030121 A1 Oct. 18, 2001

(30) Foreign Application Priority Data

Apr. 4, 2000 (JP) ..... 2000-102187

(51) Int. Cl.[7] ..... H01B 7/34
(52) U.S. Cl. ..... 174/36
(58) Field of Search ..... 174/36, 28, 102 R, 174/102 A, 102 SC, 102 P, 105 R, 106 R, 126.1, 126.4, 110 R; 333/243, 246

(56) References Cited

U.S. PATENT DOCUMENTS 3,320,554 A * 5/1967 Wieder ..... 333/24.1
3,886,506 A * 5/1975 Lorber et al. ..... 333/96
4,301,428 A * 11/1981 Mayer ..... 333/12
4,371,742 A 2/1983 Manly
4,383,225 A * 5/1983 Mayer ..... 333/12
4,510,468 A * 4/1985 Mayer ..... 333/12
5,756,207 A * 5/1998 Clough et al. ..... 428/375

FOREIGN PATENT DOCUMENTS

JP 11-185542 A * 7/1999 ..... H01B/11/08

OTHER PUBLICATIONS

Copy of European search report, Jul. 10, 2001.

* cited by examiner

*Primary Examiner*—Dean A. Reichard
*Assistant Examiner*—William H. Mayo, III
(74) *Attorney, Agent, or Firm*—Bradley N Ruben, PC

(57) ABSTRACT

A signal transmission cable (10) having a conductor portion for transmitting signals and an insulator sheath (14) covering the conductor portion, and a high loss magnetic film (15) [is] formed on at least one part of the outer surface of the insulator sheath. The high loss magnetic film has the maximum complex permeability $\mu''_{max}$ in a frequency range of 0.1–10 gigahertz (GHz). An example of a magnetic composition of the high loss magnetic film is a M-X-Y magnetic composition wherein M is a metallic magnetic material selected from among Fe, Co, and/or Ni, X is an element or elements other than M and Y, and Y is F, N, and/or O, the M-X-Y magnetic composition having a sufficient concentration of M in the composition so that the M-X-Y magnetic compostion has a saturation magnetization of 35–80% of that of the metallic magnetic material M alone.

39 Claims, 5 Drawing Sheets

SIGNAL TRANSMISSION CABLE WITH A NOISE ABSORBING HIGH LOSS MAGNETIC FILM FORMED ON A SHEATH OF THE CABLE

BACKGROUND OF THE INVENTION

This invention relates to a signal transmission cable comprising a conductor portion for transmission of an electrical signal and an insulator sheath covering the conductor portion and, in particular, to such a signal transmission cable having a noise absorber suppressing noise leaking out of and invading into the cable.

In order to transmit electrical signals such as communication signals between electronic devices and between electronic apparatus, use is made of signal transmission cables such as communication cables. A typical one of the transmission cables usually comprises a conductor portion for transmission of signals therethrough and an outer insulator sheath surrounding the conductor portion. A coaxial type of the signal transmission cables comprises a central conductor portion for transmission of signals therethrough, an outer conductor portion to be grounded, an insulator layer interposed and insulating between the central conductor portion and the outer conductor portion, and an outer insulator sheath surrounding the outer conductor portion. It is well known as the so called electromagnetic interference (EMI) that high frequency electrical noise is generated from active electronic elements, high frequency circuit components, and high frequency electronic apparatus, flows through the signal transmission cable and is radiated from the cable. On the contrary, electrical noise invades through the signal transmission cable to those active electronic elements, high frequency circuit components, and high frequency electronic apparatus.

It is well known in the art that a cylindrical ferrite core is attached onto an electric power code to an electronic apparatus, for example, computer so as to suppress a high frequency noise from flowing into, or from, the computer through the electric power code. The ferrite core absorbs the high frequency noise current flowing through the power code. The ferrite core used has a large volume in comparison with electronic apparatus which have rapidly been small-sized with electronic circuit components disposed at a high density.

It is also well known in the art that a concentrated constant circuit such as a decoupling capacitor is assembled in a power circuit line in the electronic apparatus so as to suppress undesired radiation from the power line.

It is also another problem that a high frequency noise is often caused or induced from a semiconductor or an integrated circuit device of a high speed operation type such as a random access memory (RAM), a read only memory (ROM), a microprocessor (MPU), a central processing unit (CPU), or an image processor arithmetic logic unit (IPALU) because an electric signal flows in a high speed circuit therein with rapid change in current and voltage value.

In addition, electronic elements and cables are disposed with a high density in a small-sized electronic apparatus. Therefore, those elements and lines are very close to each other and thereby affected to each other to cause EMI.

In order to suppress the high frequency noise from those semiconductor devices and the EMI within the small-sized electronic apparatus, the conventional ferrite core cannot be used because it has a relatively large volume.

On the other hand, use of the concentrated constant circuit cannot sufficiently suppress the high frequency noise caused in the circuit using electronic elements of the high speed operation type because the noise has an increased frequency so that the circuit line actually acts as a distributed constant circuit.

Japanese Unexamined Patent Publication (JP-A) H11-185542 discloses a cable with a thin-film magnetic shield. The cable is generally used as an interface cable for connecting OA (office automation) apparatus such as a personal computer, game apparatus, and communication equipment to one another and as an internal wiring cable for connection of various components in the apparatus.

A first conventional cable with a thin-film magnetic shield is disclosed in the above-mentioned Japanese publication and comprises a plurality of signal conductors as a conductor portion arranged at the center for transmission of signals, an insulating tape wrapped around the conductor portion, a laminated tape wrapped around the insulating tape, and an insulator covering the laminated tape. The laminated tape comprises a laminate of a metal leaf or foil having high conductivity and at least one high-permeability thin film made of a material having high permeability.

With this structure, radiation noise is effectively shielded. Specifically, since the metal leaf (typically, copper leaf) having high conductivity is surrounded by the high-permeability thin film, the radiation noise surviving through the metal leaf without being absorbed thereby can be shielded by the high-permeability thin film. Thus, the radiation noise is first shielded by the metal leaf, and then by the high-permeability thin film arranged therearound. As a consequence, the above-mentioned cable is improved in shielding effect over a wide range, easy in handling, and smart in appearance because the diameter of the cable need not substantially be increased.

A second conventional cable with a thin-film magnetic shield is also disclosed in the above-mentioned publication. This cable is similar in structure to the first conventional cable mentioned above except that the insulating tape is provided with slits. With this structure, the cable as a whole is prevented from occurrence of an antenna effect and the influence of eddy current of the high-permeability thin film is suppressed. Therefore, it is possible to suppress the radiation noise over a wide frequency band.

However, the high frequency current or the high frequency radiation noise contains a harmonic component. In this event, a signal path exhibits the behavior as a distributed constant circuit. Therefore, the conventional countermeasure against the noise is not effective because such countermeasure assumes the lumped constant circuit.

In the above-mentioned publication, the high-permeability thin film is typically a magnetic thin film formed by rolling a permalloy (Fe—Ni alloy). Such magnetic thin film as the high-permeability thin film has following problems. Specifically, the frequency characteristic ("f" characteristic) of the magnetic characteristic thereof is inferior particularly at the high frequency. In addition, the electric characteristic is degraded.

Alternatively, use may be made of the high-permeability thin film made of a Co-based amorphous material, for example, Co—Fe alloy. In this case, however, the frequency characteristic of the magnetic characteristic thereof is inferior particularly at the high frequency, like in the above-mentioned case. Furthermore, although the Co-based amorphous material can be manufactured in a laboratory, the cost is high. Accordingly, this material can not practically be used in the industry.

SUMMARY OF THE INVENTION

It is therefore an object of this invention to provide a signal transmission cable capable of efficiently suppressing only a high frequency noise.

It is another object of this invention to provide a signal transmission cable capable of achieving the above-mentioned effect without requiring any additional space.

This invention is applicable to a signal transmission cable comprising a conductor portion for transmitting an electric signal therethrough and an insulator sheath covering said conductor portion. A typical example of the signal transmission cable is a coaxial cable further comprising an outer conductor portion around said conductor portion and an inner insulator layer disposed between said conductor portion and said outer conductor portion, said outer conductor portion being directly covered with said insulating sheath. According to this invention, the signal transmission cable is provided with a high loss magnetic film formed on at least one area of said insulator sheath and covering at least a part of an outer surface of said sheath. The high loss magnetic film has the maximum complex permeability $\mu''_{max}$ in a frequency range of 0.1–10 gigahertz (GHz).

It is preferable that the high loss magnetic film has a DC specific resistance of 100 $\mu\Omega\cdot$cm or more.

It is also preferable that the high loss magnetic film has a thickness of 0.3–20 $\mu$m.

According to an embodiment, the high loss magnetic film is a thin film formed by sputtering process, or alternatively by vapor deposition process.

It is preferable that the high loss magnetic film is covered with an outer insulating sheath.

The high loss magnetic film is preferably made of a M-X-Y magnetic composition which is comprising M, X and Y, where M is a metallic magnetic material consisting of Fe, Co, and/or Ni, X being element or elements other than M and Y, and Y being F, N, and/or O, said M-X-Y magnetic composition having a concentration of M in the composition so that said M-X-Y magnetic composition has a saturation magnetization of 35–80% of that of the metallic bulk of magnetic material comprising M alone.

According to an embodiment of this invention, the M-X-Y magnetic composition has a saturation magnetization which is 60–80% of the saturation magnetization of the metallic magnetic material M alone. The M-X-Y magnetic composition has a complex permeability frequency response of a relatively narrow band where a relative bandwidth bwr is 200% or less. The relative bandwidth bwr is determined as a percentage ratio of bandwidth between two frequency points which shows the complex permeability as a half value $\mu''_{50}$ of the maximum $\mu''_{max}$, to center frequency of said bandwidth. The M-X-Y magnetic composition has a DC specific resistance of 100–700 $\mu\Omega\cdot$cm.

According to another embodiment, the M-X-Y magnetic composition has a saturation magnetization which is 35–60% of the saturation magnetization of the metallic magnetic material M alone. The M-X-Y magnetic composition has a complex permeability frequency response of a relatively broad band where a relative bandwidth bwr is 150% or more. The relative bandwidth bwr is determined as a percentage ratio of bandwidth between two frequency points which shows the complex permeability as a half value $\mu''_{50}$ of the maximum $\mu''_{max}$, to center frequency of said bandwidth. The M-X-Y magnetic composition has a DC specific resistance of 500 $\mu\Omega\cdot$cm or more.

The M-X-Y magnetic composition is a granular magnetic composition wherein said metallic magnetic material M is distributed as granular grains in a matrix composition consisting of X and Y The granular grains preferably have an average grain size of 1–40 nm.

Typically, X is at least one selected form a group consisting of C, Bi, Si, Al, Mg, Ti, Zn, Hf, Sr, Nb, Ta, and rare-earth metals.

According to an embodiment, the M-X-Y magnetic composition is a composition represented by a formula of $Fe_{\alpha}$—$Al_{\beta}$—$O_{\gamma}$.

DESCRIPTION OF PREFERRED EMBODIMENTS

Figure 1:
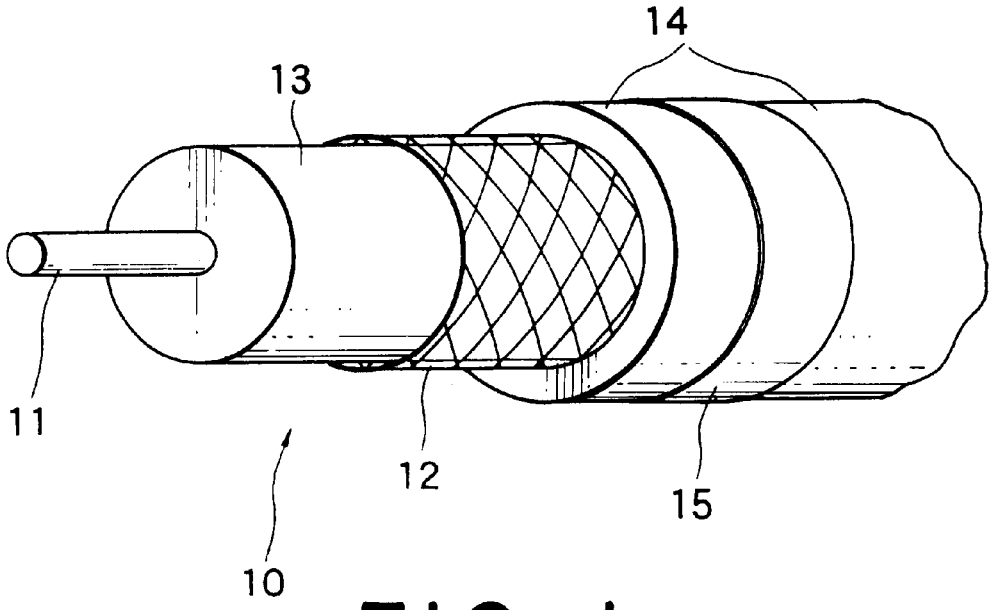
FIG. 1 is a schematic perspective view showing a signal transmission cable according to a first embodiment of this invention.

Now, description will be made of embodiments of this invention with reference to the drawing.

At first referring to FIG. 1, a signal transmission cable 10 according to a first embodiment of this invention is a coaxial cable. The cable 10 comprises a center conductor 11, a cylindrical outer conductor 12 arranged around the center conductor 11 to be concentric therewith, and an insulator 13 interposed between the center conductor 11 and the cylindrical outer conductor 12.

The center conductor 11 may also be called an inner conductor and is made of, for example, an annealed copper wire. The insulator 13 may be made of a material having a low dielectric loss, such as polyethylene. The outer conductor 12 illustrated in the figure is of a mesh of copper wire. Without being restricted thereto, the outer conductor 12 may comprise an aluminum pipe or an aluminum tape.

In either event, a combination of the center conductor 11, the outer conductor 12, and the insulator 13 serves as a conductor portion for transmission of signals. The conductor portion is covered with a sheath 14. The sheath 14 may be made of a material, such as polyvinyl chloride, polyethylene, polyimide resin, or the like.

The signal transmission cable 10 of this embodiment includes a high loss magnetic film 15 having complex permeability and formed on at least a part of the surface of the sheath 14.

Figure 2:
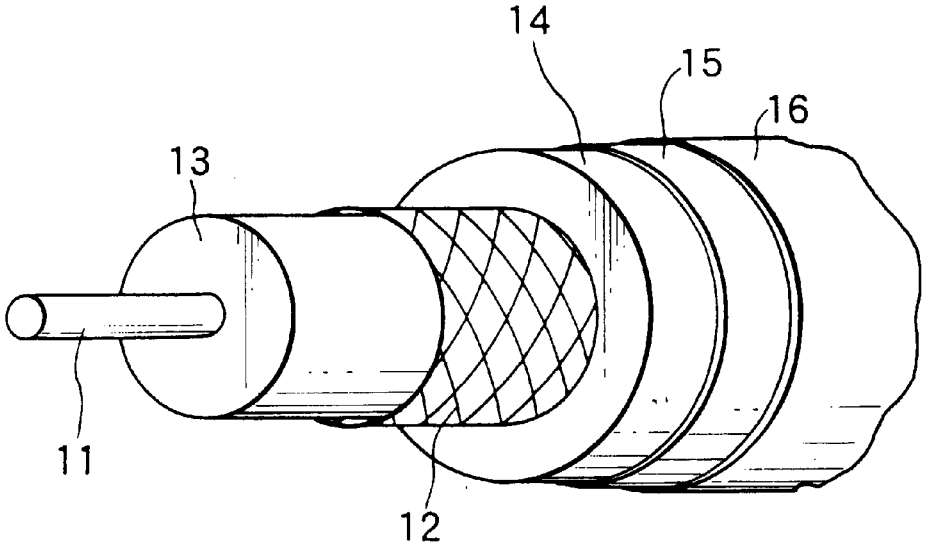
FIG. 2 is a schematic perspective view showing a signal transmission cable according to a second embodiment of this invention.

Referring to FIG. 2, a signal transmission cable has according to a second embodiment of this invention is similar in structure to that illustrated in FIG. 1 except that a second or outer sheath 16 of an insulating material is formed around the high loss magnetic film 15. The outer sheath 16 covers the above-mentioned sheath 14, which may be called an inner sheath, and the high loss magnetic film 15. The insulator 16 serves to insulate the surface of the signal transmission cable 10.

For the high loss magnetic film 15 above-mentioned, it is preferable to use following magnetic substance.

It is understood from the recent research that use of the magnetic substance having the magnetic loss factor or the complex permeability $\mu''$ is considered as an effective resistance added to the circuit generating the noise so that the noise can be attenuated. The effective resistance is dependent on the complex permeability $\mu''$ of the magnetic substance used. In detail, providing that the magnetic substance has a constant area, it is certain that the effective resistance is dependent on the complex permeability $\mu''$ and the thickness of the magnetic substance. This means that the magnetic substance having an increased complex permeability could provide a high frequency noise suppressor with a reduced volume, that is, a reduced size in area and thickness.

Therefore, this invention aims to provide a magnetic substance having an increased complex permeability or a high magnetic loss at a high frequency, preferably the maximum value of the complex permeability within a quasimicrowave range of 0.1–10 GHz even if the thickness is at small as 2.0 g m or less.

As one of magnetic substances having a low magnetic loss and a high saturation magnetization, a M-X-Y magnetic composition (M: magnetic metallic element, Y: O, N, or F, X: element or elements other than M and Y) is known in the prior art, which is mainly produced by the sputtering method or the vapor deposition method and has a granular structure where metallic magnetic particles of M are dispersed in a non-magnetic matrix (X and Y) like ceramics.

During searching fine structures of the M-X-Y magnetic composition having the excellent permeability, the present inventors found out that the high saturation magnetization can be realized in a high concentration region of M where the M-X-Y magnetic composition has a saturation magnetization of 80% or more of that of the metallic bulk of magnetic material comprising M alone The M-X-Y magnetic composition has a low specific resistance. Therefore, when it is formed in a part having a relatively large thickness which is used in a high frequency range, the part permits an eddy current to flow therein. As a result, the part is reduced in permeability. Therefore, the conventional M-X-Y magnetic composition having the high saturation magnetization cannot be used for part having an increased thickness.

It was further found out that the M-X-Y magnetic composition having a reduced concentration of M has an increased complex permeability $\mu''$ in a high frequency range. In a reduced concentration region of M where the M-X-Y magnetic composition has a saturation magnetization of 60–80% of that of the metallic bulk of magnetic material comprising M alone, the M-X-Y magnetic composition has a relatively high specific resistance about 100 $\mu\Omega\cdot$cm or more. Therefore, if a part having a relatively thickness such as several micrometers ($\mu$m) is formed of the composition with the reduced concentration of M, it shows a reduced loss due to the eddy current. The magnetic loss or complex permeability is a loss due to the natural resonance. Therefore, the distribution of the complex permeability on a frequency axis is narrow. This means that the M-X-Y magnetic composition with the reduced concentration of M is useful for suppression of noise within a narrow frequency range.

In a further reduced concentration of M where the M-X-Y magnetic composition has a saturation magnetization of 35–60% of that of the metallic bulk of magnetic material comprising M alone, the M-X-Y magnetic composition has a higher specific resistance about 500 $\mu\Omega\cdot$cm or more. Therefore, the loss due to the eddy current is further reduced in a part made of the composition and having a relatively thickness such as several micrometers ($\mu$m). Magnetic mutual effect between M particles becomes small so that the spin heat fluctuation becomes large to cause fluctuation of that frequency at which the natural resonance of the complex permeability generates. Therefore, the complex permeability $\mu''$ has a relatively large value over a broad frequency range. This means that the M-X-Y magnetic composition with the further reduced concentration of M is useful for suppression of noise within a broad frequency range.

In a more reduced concentration of M, particles of M do not magnetically effect to each other so that the M-X-Y composition exhibits the super paramagnetism.

In design of a part made of magnetic substance to be disposed adjacent an electronic circuit so as to suppress a high frequency noise, a value of a product ($\mu''\cdot\delta$) of the complex permeability $\mu''$ and a thickness $\delta$ of the magnetic substance is considered. Generally, $(\mu''\cdot\delta)\geqq 1000$ $\mu$m is required for effectively suppressing high frequency noise of hundreds megahertz (MHz). When the magnetic composition used has the complex permeability of about 1000 ($\mu''=1000$), the noise suppressor is required to have a thickness of 1 micrometer ($\mu$m) or more. Therefore, the composition having a low specific resistance is not desired because the eddy current is easily generated but is desired to have an increased specific resistance such as 100 $\mu\cdot\Omega$ or more.

In the view point of the above, M-X-Y magnetic composition used for the noise suppressor is desired to have a reduced concentration of M where the M-X-Y magnetic composition has a saturation magnetization of 35–80% of that of the metallic bulk of magnetic material comprising M alone.

Therefore, the high loss magnetic film is preferably made of the M-X-Y magnetic composition which has a reduced concentration of M where the M-X-Y magnetic composition has a saturation magnetization of 35–80% of that of the metallic bulk of magnetic material comprising M alone.

The M-X-Y magnetic composition which has a reduced concentration of M where the M-X-Y magnetic composition has a saturation magnetization of 35–80% of that of the metallic bulk of magnetic material comprising M alone is proposed in International Patent Application No. PCT/JP01/00437 filed on Jan. 24, 2001 corresponding to Japanese patent application No. 2000–52507 filed on Jan. 24, 2000, which is referred to herein and is incorporated to the present description.

Typically, the high loss magnetic film 15 shown in FIG. 1 or 2 is a granular magnetic film of the M-X-Y magnetic composition.

Figure 3:
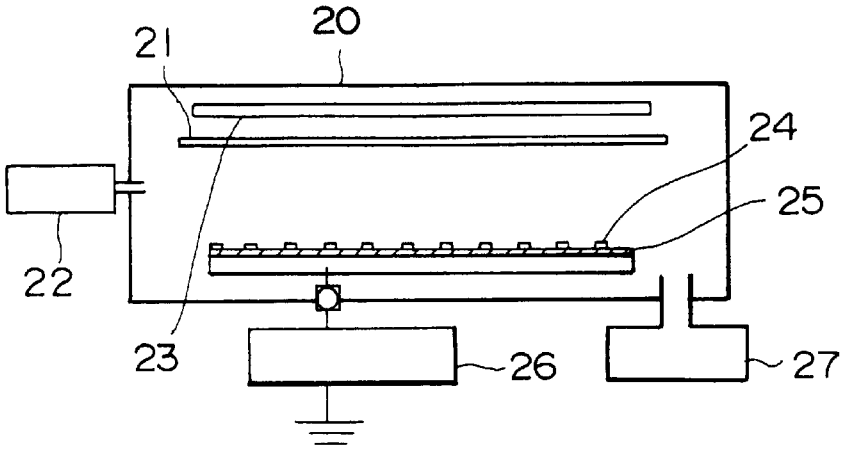
FIG. 3 is a schematic sectional view showing the structure of a sputtering apparatus which was used in examples.

Referring to FIG. 3, a sputtering apparatus shown therein was used for producing samples of the granular magnetic film. The sputtering apparatus has a conventional structure and comprises a vacuum container 20, a shutter 21, an atmospheric gas source 22, a substrate or a glass plate 23, chips 24 (X or X-Y), a target 25 (M), an RF power source, and a vacuum pump 27. The atmospheric gas source 22 and the vacuum pump 27 are connected to the vacuum container 20. The substrate 23 confronts to the target 25 on which chips 24 are disposed. The shutter 21 is disposed in front of the substrate 21. The RF power source 26 is connected to the target 25.

EXAMPLE 1

A thin film of M-X-Y magnetic composition was made on a glass plate by the use of the sputtering apparatus illustrated in FIG. 3 at the following sputtering condition.

The target 25 was a Fe disk having a diameter of 100 mm with 120 pieces of $Al_2O_3$ chips arranged thereon. Each chip had a size of 5 mm×5 mm×2 mm. Then, by the use of the vacuum pump 27, the vacuum container 20 was kept at a vacuum degree of about $1.33\times10^{-4}$ Pa and was supplied with an Ar gas from the atmospheric gas source 22. Subsequently, RF power was supplied from the RF power source 26. Under this condition, a magnetic film was formed on the glass substrate as the substrate 23 by the sputtering method. Thereafter, the magnetic film thus obtained was subjected to heat treatment for 2 hours in the vacuum magnetic field under a thermal condition of 300° C. As a result, a film sample 1 of the above-mentioned granular magnetic film was obtained.

The film sample 1 thus obtained was analyzed by a fluorescent X-ray spectroscopy and confirmed as a film having a composition $Fe_{72}Al_{11}O_{17}$. The film sample 1 was equal to 2.0 μm in thickness, 530 μΩ·cm in DC specific resistance, 1422 A/m in anisotropy field (Hk), and 1.68 T in saturation magnetization (Ms).

A percent ratio of the saturation magnetization of the film sample 1 and that of the metallic material M itself, as given by {Ms(M-X-Y)/Ms(M)}×100, was equal to 72.2%.

The measurement was carried out several times for different values of the bias magnetic field. From the measured impedance variation in response to frequency variation, the complex permeability frequency response ($\mu''$-f response) was calculated and is shown in FIG. 4.

Figure 4:
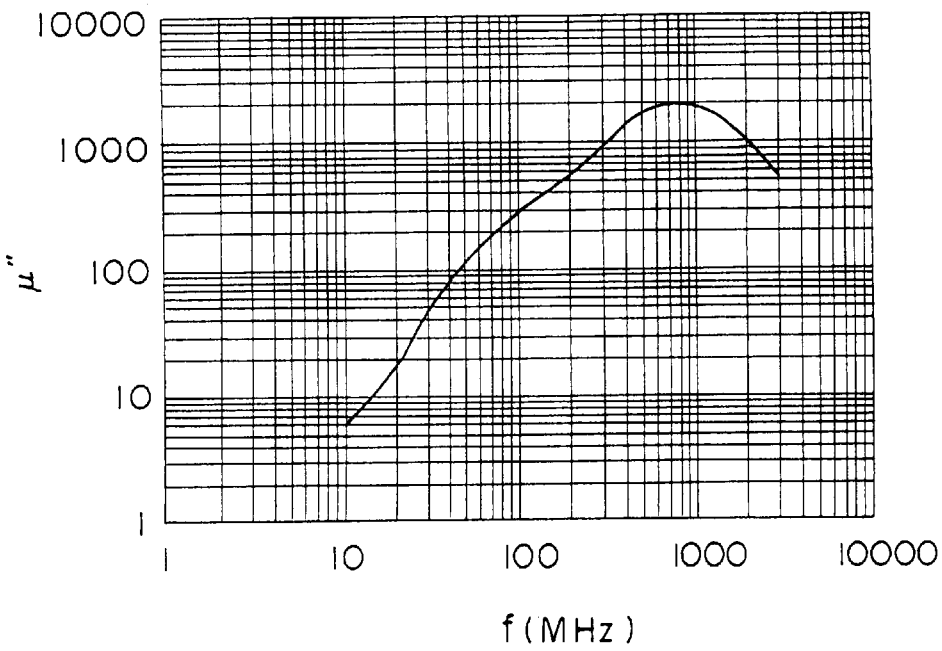
FIG. 4 is a graphical view showing a frequency response of a complex permeability of film sample 1 in Example 1.

It will be noted from FIG. 4 that the complex permeability has a high peak or the maximum value ($\mu''_{max}$) and rapidly falls on either side of the peak. The natural resonance frequency ($f(\mu''_{max})$) showing the maximum value ($\mu''_{max}$) is about 700 MHz. From the $\mu''$-f response, a relative bandwidth bwr was determined as a percentage ratio of bandwidth between two frequency points which show the complex permeability as a half value $\mu''_{50}$ of the maximum $\mu''_{max}$, to center frequency of said bandwidth. The relative bandwidth bwr was equal to 148%.

EXAMPLE 2

In a condition similar to that in Example 1 but using of 150 $Al_2O_3$ chips, a film sample 2 was formed on a glass plate.

The film sample 2 produced was analyzed by a fluorescent X-ray spectroscopy and confirmed as a film of a composition $Fe_{44}Al_{22}O_{34}$. The film sample 2 had 1.2 micrometer (μm) in thickness, 2400 micro ohm centimeters (μΩ·cm) in DC specific resistance, 120 Oe in anisotropy field (Hk), and 9600 Gauss in saturation magnetization (Ms). It will be noted that film sample 2 is higher than film sample 1 in the specific resistance.

A percent ratio of the saturation magnetization of the film sample 2 and that of the metallic material M itself {Ms(M-X-Y)/Ms(M)}×100 was 44.5%.

Figure 4A:
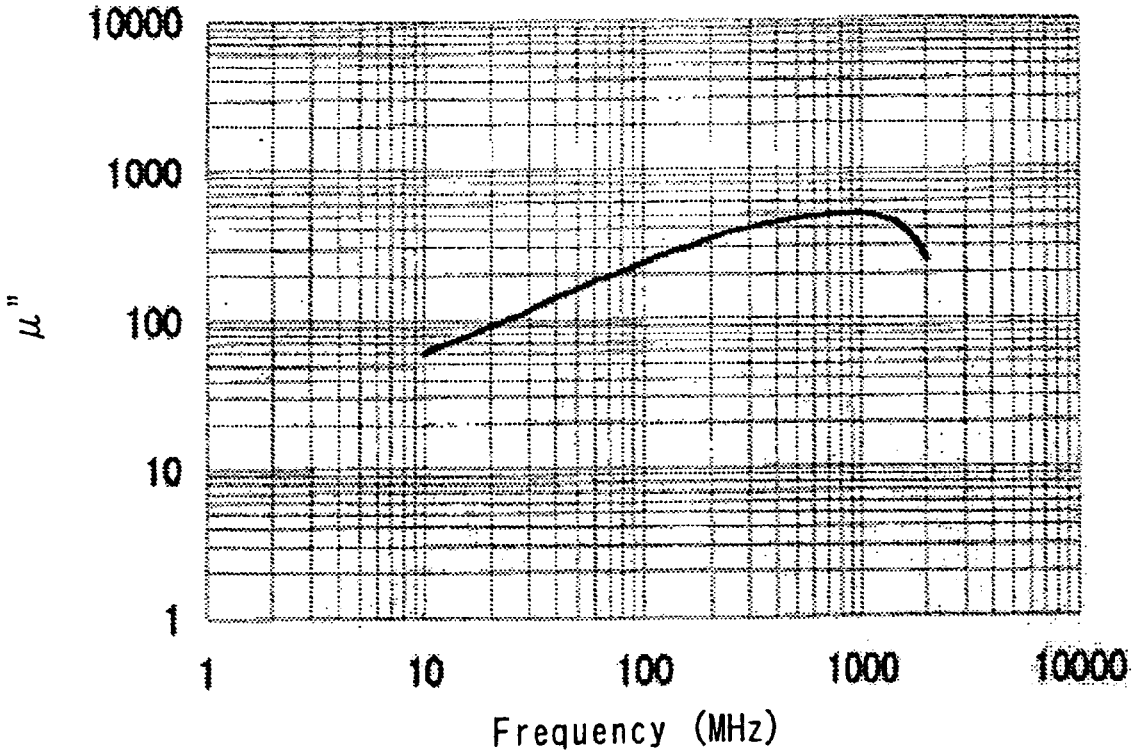
FIG. 4A is a graphical view showing a frequency response of a complex permeability of film sample 2 in Example 2.

The $\mu''$-f response of film sample 2 was also obtained in the similar manner as in Example 1 and shows in FIG. 4A. It is noted that the peak has also a high value similar to that in film sample 1. However, the frequency point at the peak, or the natural resonance frequency is about 1 GHz and the complex permeability gradually falls either side of the peak so that the $\mu''$-f response has a broadband characteristic.

A relative bandwidth bwr of film sample 2 was also confirmed as 181% by the similar way as in Example 1.

Now, description will be made as to tests relating to the noise suppressing effect of the sample film, which were carried out using a test apparatus 30 shown in FIG. 5.

Figure 5:
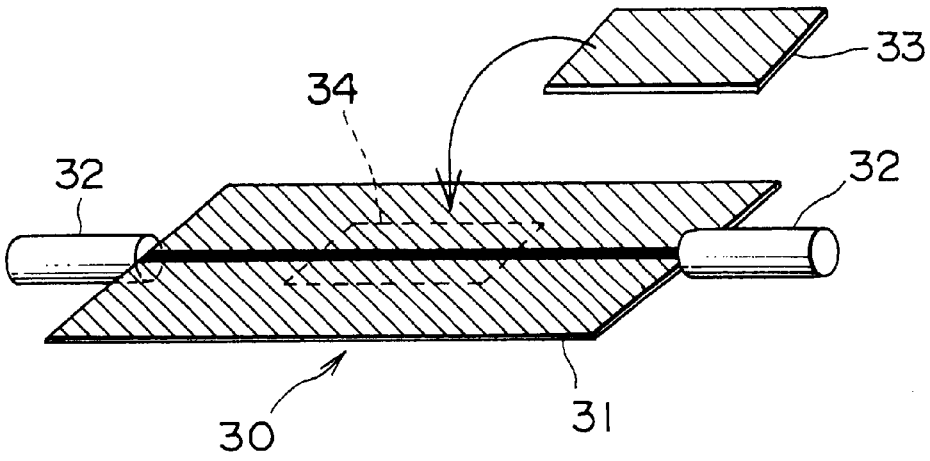
FIG. 5 is a schematic perspective view of a test apparatus for testing a noise suppressing effect of magnetic samples.

Referring to FIG. 5, the test apparatus 30 comprises a micro-strip line 31 having two ports, coaxial cables 32 connected to the two ports, and a network analyzer (not shown) connected across the two ports. The micro-strip line 31 has a line length of 75 mm and a characteristic impedance Zc of 50 ohms. The test piece 33 was disposed at a region 34 on the micro-strip line 31 and the transmission characteristic $S_{21}$ was measured.

In case of the test apparatus 30 shown in FIG. 5, a high frequency current is suppressed by addition of an equivalent resistance value to the micro-strip line 31 to be adjacent the test piece 33 of the high loss magnetic film. In this case, the effect of suppressing the high frequency current is almost proportional to the value of a product ($\mu''\cdot\delta$) of the complex permeability $\mu''$ and a thickness δ of the magnetic substance.

Figure 6:
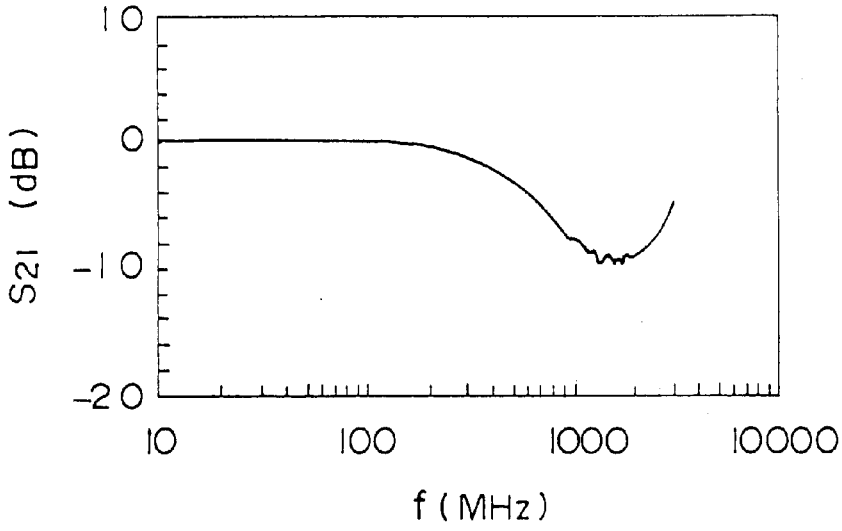
FIG. 6 is a graphic view showing a transmission characteristic of film sample 1.

Referring to FIG. 6, the frequency response of $S_{21}$ for film sample will be described.

With respect to use of the film sample, it will be noted from FIG. 6 that the $S_{21}$ (dB) reduces above 100 MHz, becomes to the minimum of −10 dB at a frequency of 2 GHz, and then increases above 2 GHz. The results demonstrate that the frequency response of $S_{21}$ is dependent on the frequency distribution of the complex permeability $\mu''$ and that the noise suppressing effect is dependent on the product of ($\mu''_{max}\times\delta$).

Figures 7A, 7B, 7C:
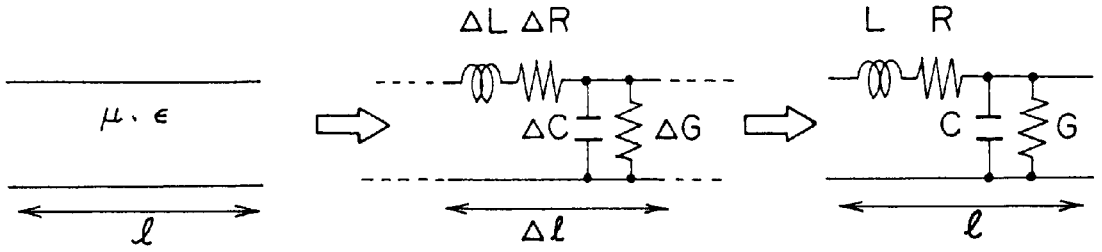
FIG. 7A shows a distributed constant circuit with a length l, showing a magnetic material as a noise suppressor.
FIG. 7B is an equivalent circuit with a unit length $\Delta$l of the distributed constant circuit of FIG. 7A.
FIG. 7C is an equivalent circuit with a length l of the distributed constant circuit of FIG. 7A.

Now, providing that the magnetic sample forms a distributed constant circuit having a length of l as shown in FIG. 7A, an equivalent circuit was calculated for a unit length of Δl from transmission characteristics $S_{21}$, as shown in FIG. 7B. Then, the equivalent circuit for the length l was obtained from the equivalent circuit for the unit length Δl, as shown in FIG. 7C. The equivalent circuit of the magnetic sample comprises series inductance L and resistance R and parallel capacitance C and conductance G, as shown in FIG. 7C. From this, it will be understood that the change in transmission characteristic of the micro-strip line caused due to disposition of the high loss magnetic film on the micro-strip line is mainly determined by the equivalent resistance R added in series.

Figure 8:
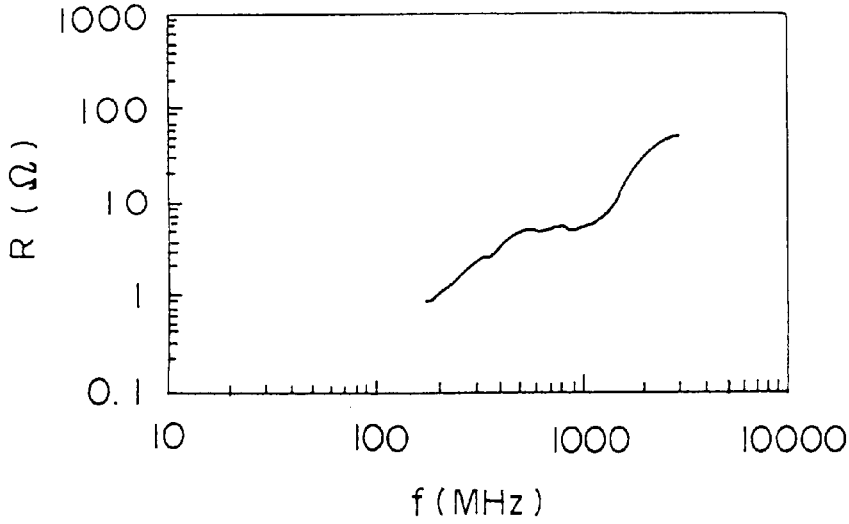
FIG. 8 is a graphic view showing a frequency response of an equivalent resistance R of film sample 1 in Example 1.

In view of the above, a frequency response of the equivalent resistance R was measured. The measured data are shown in FIG. 8 for the film sample. It will be noted from the figure that the equivalent resistance R gradually reduces in the quasi-microwave range and is about several tens ohms at about 3 GHz. It is seen that the frequency dependency of the equivalent resistance R is different from that of the complex permeability $\mu''$ which has the maximum value at about 1 GHz.

Therefore, it should be effective that the sample showing the frequency distribution of the complex permeability $\mu''$ in the quasi-microwave range is applied to the suppression of the radiation noise into wide-band of the high frequency at about 1 GHz.

It will be supposed that this difference is based on the gradual increase of a ratio of the product and the sample length to the wavelength.

Production method of the high loss magnetic film of this invention has been described as to the sputtering method and the vapor deposition method but they do not restrict the production method. Any other film producing method such as ion beam deposition method and gas deposition method can be used for production of the magnetic substance of the present invention if they can evenly produce the high loss magnetic film of the present invention.

In the embodiments, the heat treatment after film production is carried out in the vacuum magnetic field. However, in case of the as-deposited film having the composition or using the deposition method adapted to achieve the performance of this invention, treatment after film deposition is not restricted to that described in the embodiment.

While the coaxial cable has been described as the signal transmission cable in the embodiment, this invention is also applicable to other various shielded cables. In the embodiment described above, the high loss magnetic film is formed on a part of the sheath. However, one sheet or several pieces of the film may cover the entire surface of the sheath.

While the granular magnetic film has been described as the high loss magnetic film, this invention is also applicable to any magnetic film having a high magnetic loss at a high frequency range of several 10 MHz to several GHz.

Thus, in the signal transmission cable according to the present invention, the high loss magnetic film is formed on at least a part of the surface of the sheath. Therefore, it is possible to efficiently suppress only high-frequency leaking current, which would otherwise be produced around the signal transmission cable, without requiring substantial increase in space. Further, the high loss magnetic film is also applicable to a balum or accessories therefor.

What is claimed is:

1. A signal transmission cable comprising a conductor portion for transmitting an electric signal therethrough and an insulator sheath covering said conductor portion, wherein a high loss magnetic film is formed on at least one area of said insulator sheath and covers at least a part of an outer surface of said sheath, said high loss magnetic film having a thickness of 0.3–20 $\mu$m and the maximum complex permeability $\mu''_{max}$ in a frequency range of 0.1–10 gigahertz (GHz).

2. A signal transmission cable as claimed in claim 1, wherein said high loss magnetic film is a thin film formed by sputtering process.

3. A signal transmission cable as claimed in claim 1, wherein said high loss magnetic film is a thin film formed by vapor deposition process.

4. A signal transmission cable as claimed in claim 1, which is a coaxial cable further comprising an outer conductor portion around said conductor portion and an inner insulator layer disposed between said conductor portion and said outer conductor portion, said outer conductor portion being directly covered with said insulating sheath.

5. A signal transmission cable as claimed in claim 1, which further comprises an outer insulating sheath covering said high loss magnetic film.

6. A signal transmission cable comprising a conductor portion for transmitting an electric signal therethrough and an insulator sheath covering said conductor portion, wherein a high loss magnetic film is formed on at least one area of said insulator sheath and covers at least a part of an outer surface of said sheath, said high loss magnetic film having a thickness of 0.3–20 $\mu$m, a DC specific resistance of 100 $\mu\Omega$·cm or more, and the maximum complex permeability $\mu''_{max}$ in a frequency range of 0.1–10 gigahertz (GHz).

7. A signal transmission cable as claimed in claim 6, wherein said high loss magnetic film is a thin film formed by sputtering process.

8. A signal transmission cable as claimed in claim 6, wherein said high loss magnetic film is a thin film formed by vapor deposition process.

9. A signal transmission cable as claimed in claim 6, which is a coaxial cable further comprising an outer conductor portion around said conductor portion and an inner insulator layer disposed between said conductor portion and said outer conductor portion, said outer conductor portion being directly covered with said insulating sheath.

10. A signal transmission cable as claimed in claim 6, which further comprises an outer insulating sheath covering said high loss magnetic film.

11. A signal transmission cable comprising a conductor portion for transmitting an electric signal therethrough and an insulator sheath covering said conductor portion, wherein a high loss magnetic film is formed on at least one area of said insulator sheath and covers at least a part of an outer surface of said sheath, said high loss magnetic film being made of a M-X-Y magnetic composition comprising M, X and Y, where M is a metallic magnetic material consisting of Fe, Co, and/or Ni, X being element or elements other than M and Y, and Y being F, N, and/or O, said M-X-Y magnetic composition having a concentration of M in the composition so that said M-X-Y magnetic composition has a saturation magnetization of 35–80% of that of the metallic bulk of magnetic material comprising M alone, and said high loss magnetic film having the maximum complex permeability $\mu''_{max}$ in a frequency range of 0.1–10 gigahertz (GHz).

12. A signal transmission cable as claimed in claim 11, wherein said M-X-Y magnetic composition has a complex permeability frequency response of a relatively narrow band where a relative bandwidth bwr is 200% or less, said relative bandwidth bwr is determined as a percentage ratio of bandwidth between two frequency points which shows the complex permeability as a half value $\mu''_{50}$ of the maximum $\mu''_{max}$, to center frequency of said bandwidth.

13. A signal transmission cable as claimed in claim 12, wherein said M-X-Y magnetic composition has a saturation magnetization which is 60–80% of the saturation magnetization of the metallic magnetic material M alone.

14. A signal transmission cable as claimed in claim 13, wherein said M-X-Y magnetic composition has a DC specific resistance of 100–700 $\mu\Omega$·cm.

15. A signal transmission cable as claimed in claim 11, wherein said M-X-Y magnetic composition has a complex permeability frequency response of a relatively broad band where a relative bandwidth bwr is 150% or more, said relative bandwidth bwr is determined as a percentage ratio of bandwidth between two frequency points which shows the complex permeability as a half value $\mu''_{50}$ of the maximum $\mu''_{max}$, to center frequency of said bandwidth.

16. A signal transmission cable as claimed in claim 15, wherein said M-X-Y magnetic composition has a saturation magnetization which is 35–60% of the saturation magnetization of the metallic magnetic material M alone.

17. A signal transmission cable as claimed in claim 16, wherein said M-X-Y magnetic composition has a DC specific resistance of 500 $\mu\Omega$·cm or more.

18. A signal transmission cable as claimed in claim 11, wherein said metallic magnetic material M is distributed as granular grains in a matrix composition consisting of X and Y.

19. A signal transmission cable as claimed in claim 18, wherein said granular grains have an average grain size of 1–40 nm.

20. A signal transmission cable as claimed in claim 11, wherein said high loss magnetic film is a thin film formed by sputtering process.

21. A signal transmission cable as claimed in claim 11, wherein said high loss magnetic film is a thin film formed by vapor deposition process.

22. A signal transmission cable as claimed in claim 11, wherein said high loss magnetic film has a thickness of 0.3–20 $\mu$m.

23. A signal transmission cable as claimed in claim 11, which is a coaxial cable further comprising an outer conductor portion around said conductor portion and an inner insulator layer disposed between said conductor portion and said outer conductor portion, said outer conductor portion being directly covered with said insulating sheath.

24. A signal transmission cable as claimed in claim 11, which further comprises an outer insulating sheath covering said high loss magnetic film.

25. A signal transmission cable comprising a conductor portion for transmitting an electric signal therethrough and an insulator sheath covering said conductor portion, wherein a high loss magnetic film is formed on at least one area of said insulator sheath and covers at least a part of an outer surface of said sheath, said high loss magnetic film being made of a M-X-Y magnetic composition comprising M, X and Y, where M is a metallic magnetic material consisting of Fe, Co, and/or Ni, X being at least one element selected form a group consisting of C, Bi, Si, Al, Mg, Ti, Zn, Hf, Sr, Nb, Ta, and rare-earth metals, and Y being F, N, and/or O, said M-X-Y magnetic composition having a concentration of M in the composition so that said M-X-Y magnetic composition has a saturation magnetization of 35–80% of that of the metallic bulk of magnetic material comprising M alone, and said high loss magnetic film having, a DC specific resistance of 100 $\mu\Omega$·cm or more, and the maximum complex permeability $\mu''_{max}$ in a frequency range of 0.1–10 gigahertz (GHz).

26. A signal transmission cable as claimed in claim 25, wherein said M-X-Y magnetic composition has a complex permeability frequency response of a relatively narrow band where a relative bandwidth bwr is 200% or less, said relative bandwidth bwr is determined as a percentage ratio of bandwidth between two frequency points which shows the complex permeability as a half value $\mu''_{50}$ of the maximum $\mu''_{max}$, to center frequency of said bandwidth.

27. A signal transmission cable as claimed in claim 26, wherein said M-X-Y magnetic composition has a saturation magnetization which is 60–80% of the saturation magnetization of the metallic magnetic material M alone.

28. A signal transmission cable as claimed in claim 27, wherein said M-X-Y magnetic composition has-a DC specific resistance of 100–700 $\mu\Omega$·cm.

29. A signal transmission cable as claimed in claim 25, wherein said M-X-Y magnetic composition has a complex permeability frequency response of a relatively broad band where a relative bandwidth bwr is 150% or more, said relative bandwidth bwr is determined as a percentage ratio of bandwidth between two frequency points which shows the complex permeability as a half value $\mu''_{50}$ of the maximum $\mu''_{max}$, to center frequency of said bandwidth.

30. A signal transmission cable as claimed in claim 29, wherein said M-X-Y magnetic composition has a saturation magnetization which is 35–60% of the saturation magnetization of the metallic magnetic material M alone.

31. A signal transmission cable as claimed in claim 30, wherein said M-X-Y magnetic composition has a DC specific resistance of 500 $\mu\Omega$·cm or more.

32. A signal transmission cable as claimed in claim 25, wherein said metallic magnetic material M is distributed as granular grains in a matrix composition consisting of X and Y.

33. A signal transmission cable as claimed in claim 32, wherein said granular grains have an average grain size of 1–40 nm.

34. A signal transmission cable as claimed in claim 25, wherein said M-X-Y magnetic composition is a composition represented by a formula of $Fe_{\alpha}$—$Al_{\beta}$—$O_{\gamma}$.

35. A signal transmission cable as claimed in claim 25, wherein said high loss magnetic film is a thin film formed by sputtering process.

36. A signal transmission cable as claimed claim 25, wherein said high loss magnetic film is a thin film formed by vapor deposition process.

37. A signal transmission cable as claimed in claim 25, wherein said high loss magnetic film has a thickness of 0.3–20 $\mu$m.

38. A signal transmission cable as claimed in claim 25, which is a coaxial cable further comprising an outer conductor portion around said conductor portion and an inner insulator layer disposed between said conductor portion and said outer conductor portion, said outer conductor portion being directly covered with said insulating sheath.

39. A signal transmission cable as claimed in claim 25, which further comprises an outer insulating sheath covering said high loss magnetic film.

* * * * *